US005690372A

United States Patent [19]

Jans

[11] Patent Number: 5,690,372

[45] Date of Patent: Nov. 25, 1997

[54] LATCH MECHANISM

[75] Inventor: Franz Werner Jans, Roedermark, Germany

[73] Assignee: JADO Bathroom and Hardware Mfg. Corp., Camarillo, Calif.

[21] Appl. No.: 603,432

[22] Filed: Feb. 20, 1996

[51] Int. Cl.[6] ..... E05C 1/12

[52] U.S. Cl. ..... 292/169; 292/244; 292/DIG. 60

[58] Field of Search ..... 292/169, 169.17, 292/169.19, 169.22, 224, 244, 245, 337, DIG. 60, 411

[56] References Cited

U.S. PATENT DOCUMENTS

| | | | |
|---|---|---|---|
| 4,301,667 | 11/1981 | Best et al. | 292/169.17 X |
| 4,342,101 | 7/1982 | Shih | 292/337 X |
| 4,720,127 | 1/1988 | Doolan | 292/169.22 |
| 4,844,522 | 7/1989 | Pechar | 292/169 |
| 4,852,918 | 8/1989 | Allen | 292/169 |
| 4,949,562 | 8/1990 | Thorncraft et al. | 292/169.19 X |
| 4,974,883 | 12/1990 | Jans | 292/169 |
| 5,211,169 | 5/1993 | Lin | 292/169 |

*Primary Examiner*—Rodney M. Lindsey
*Assistant Examiner*—Monica E. Millner
*Attorney, Agent, or Firm*—H. Michael Brucker

[57] ABSTRACT

A latch mechanism includes a housing containing a force transfer member. At one end of the force transfer member, a first cam mechanism is provided which is intended to be rotated by an actuator handle. At the other end of the force transfer member, a second cam mechanism is pivotably mounted to the housing and is pivoted through movements of the force transfer member responsive to rotations of the first Cam mechanism. The second cam mechanism is coupled to a latch bolt so that rotations of the first cam mechanism will result in movements of the latch bolt. The improved latch mechanism is designed to permit complete retraction of the latch bolt through rotation of the first cam mechanism by less than one-twelfth of a revolution, in either direction of rotation.

12 Claims, 3 Drawing Sheets

LATCH MECHANISM

BACKGROUND OF THE INVENTION

The present invention relates to an improved latch mechanism. In the prior art, latches are well known and are used in diverse applications, particularly to releasably secure doors. Such latch mechanisms are commonly actuated through the use of knobs or levers. However, in most latch mechanisms, the actuating knob or lever must be rotated approximately one-quarter of a revolution, or 90°, to facilitate full retraction of the latch bolt. Where a lever actuator is employed, this means that the lever, normally disposed horizontal, must be rotated to a completely downwardly pointing configuration to facilitate complete retraction of the latch bolt. Furthermore, in some latch mechanisms, the latch bolt may be retracted only through rotation of the actuator in one direction. Accordingly, a need has developed for a latch mechanism which will permit actuation regardless of the direction of rotation of the actuator and which will permit complete latch bolt retraction through rotation of the actuator a small fraction of a revolution. The present invention has been developed to fulfill this need.

SUMMARY OF THE INVENTION

The present invention relates to an improved latch mechanism. The present invention includes the following interrelated objects, aspects and features:

(A) In a first aspect, the present invention includes a generally rectangular cubic housing elongated in one direction to form, essentially, an elongated rectangular cross-sectional tube. Slidably disposed within this housing is a force transfer mechanism having a generally U-shaped cross-section and including two oppositely extending tabs slidably received within slots in the housing to limit the extent of movement of the force transfer mechanism within the housing.

(B) A first cam mechanism is rotatably mounted on the housing at a first end thereof and extends through the force transfer mechanism in a direction generally perpendicular to the direction of longitudinal extent of large lateral openings formed in the force transfer mechanism. The first cam mechanism includes a non-circular opening sized to receive a correspondingly shaped protrusion (not shown) of a lever-type actuator. The first cam mechanism includes a first cam member integrally formed therewith sized and configured to enter into either one of two oppositely located slots in the force transfer mechanism so that rotations of the first cam mechanism in either direction will result in reciprocations of the force transfer mechanism within the housing.

(C) At a second end of the housing, a second cam mechanism is pivotably mounted and includes a second cam member having a finger with the second cam member and finger extending through an opening formed in the force transfer mechanism. A latch bolt is slidably mounted within the force transfer mechanism adjacent the second cam member and includes a fitting having a recess sized to receive the finger such that movements of the finger result in movements of the latch bolt.

(D) When the first cam mechanism is rotated through rotation of the actuating lever (not shown), the first cam member engages the force transfer mechanism and reciprocates it against the force of a spring. Such movement of the force transfer mechanism causes pivoting of the second cam mechanism and, through engagement of the finger with the recess in the fitting of the latch bolt, rapid. retraction of the latch bolt within the housing. In the preferred embodiment of the present invention, the latch bolt may be completely retracted, a distance of 13 millimeters, through rotation of the first cam mechanism through a rotative angle of 28°, in either direction.

As such, it is a first object of the present invention to provide an improved latch mechanism.

It is a further object of the present invention to provide such an improved latch mechanism including a force transfer mechanism designed to transfer rotative forces imposed upon a first cam mechanism into pivoting movements of a second cam mechanism and, thereby, reciprocations of a latch bolt.

It is a yet further object of the present invention to provide such a device wherein rotation of the first cam mechanism by less than 30° results in complete retraction of the latch bolt.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
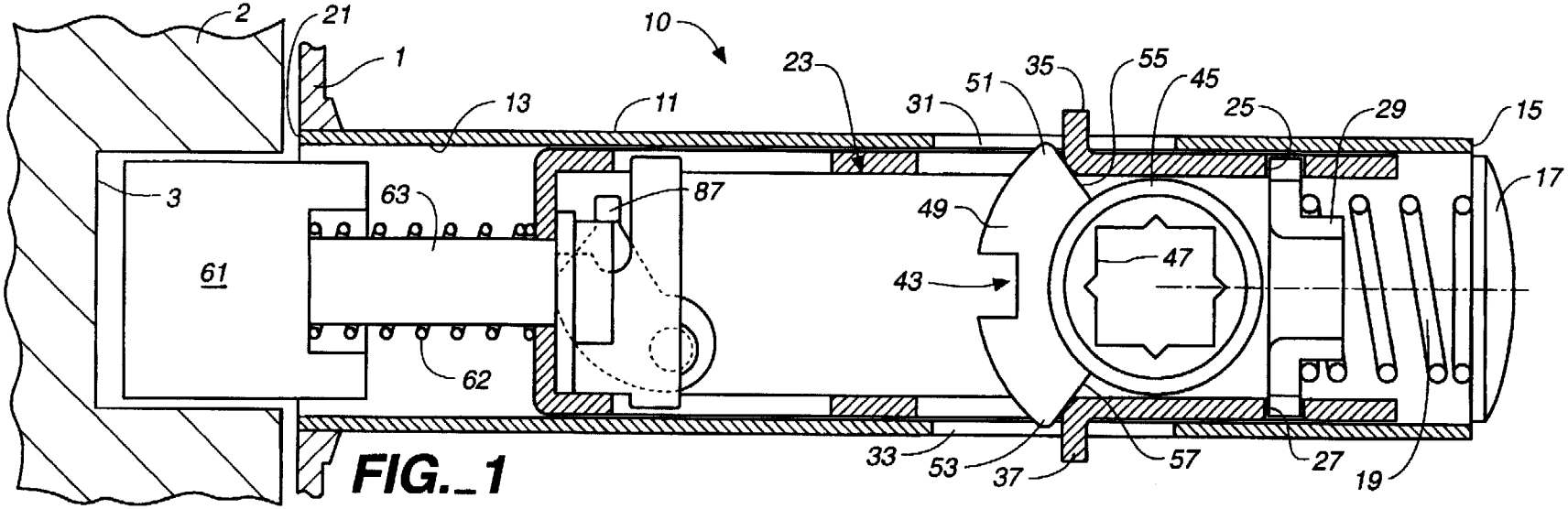
FIG. 1 shows a longitudinal cross-sectional view of the present invention in a first operative position.
Figure 1A:
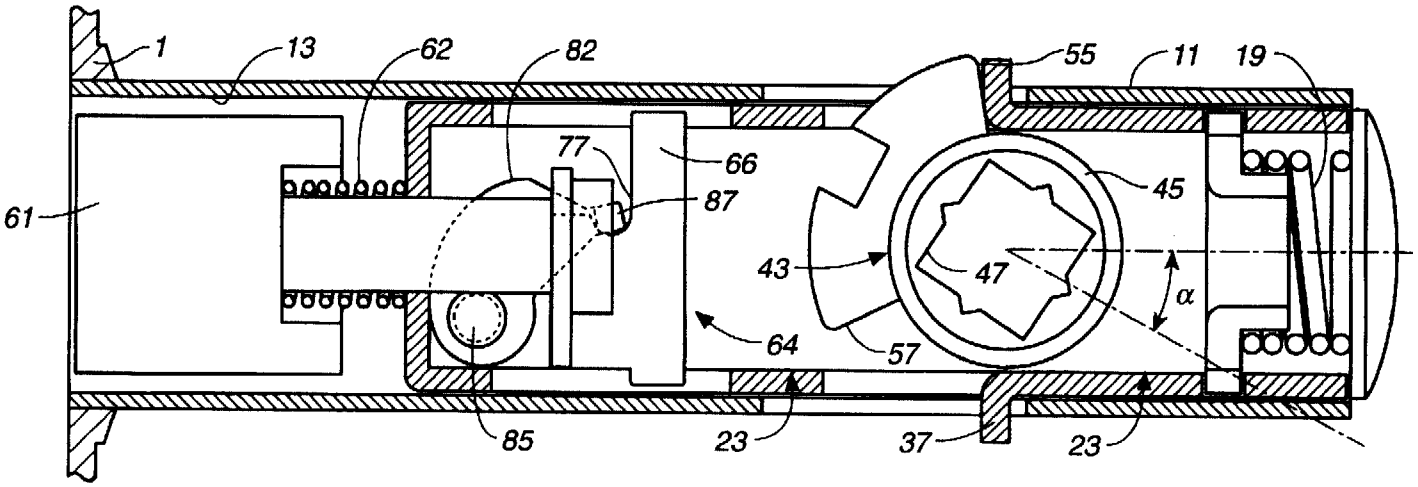
FIG. 1A shows a longitudinal cross-sectional view of the present invention in a second operational position thereof.

FIGS. 1 and 1A show portions of a door 1 in which the present invention is installed. In FIG. 1, the adjacent wall 2 is seen to include a recess 3 sized and configured to receive the latch bolt of the present invention.

Figure 3:
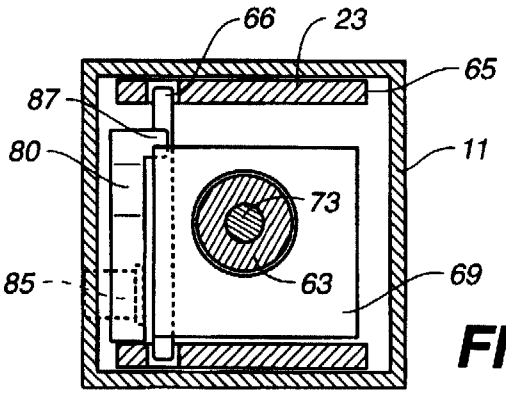
FIG. 3 shows a cross-sectional view along the line 3—3 of FIG. 2.

With reference, first, to FIGS. 1 and 1A, the present invention is generally designated by the reference numeral 10 and is seen to include a housing 11 which, with reference to FIG. 3, has a generally rectangular cross-section defining an internal chamber 13. The housing 11 has a first end 15 closed by a plug 17 retaining biasing means comprising a compression spring 19. The housing 11 has a second end 21 which is open and slidably receives a force transfer mechanism 23.

With reference to FIGS. 1, 1A, 2 and 4, the force transfer mechanism 23 includes opposed slots 25 and 27 which receive a spring stop 29 designed to transfer force from the compression spring 19 to the force transfer mechanism 23. The housing 11 includes opposed slots 31 and 33 which slidably receive respective outwardly extending opposed tabs 35 and 37 on the force transfer mechanism 23 with the forward and rearward extent of the slots 31 and 33 cooperating with the respective tabs 35 and 37 to define the limits of sliding movement of the force transfer mechanism 23 within the chamber 13 of the housing 11.

Figure 2:
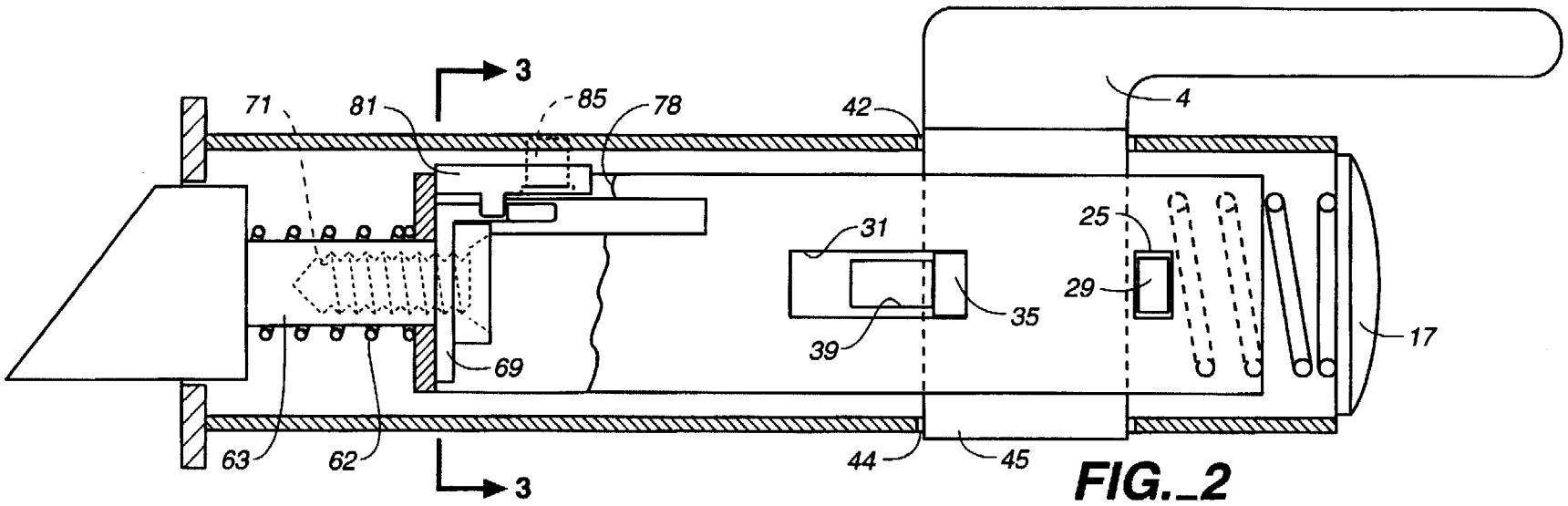
FIG. 2 shows a longitudinal cross-sectional view of the present invention rotated 90° from the views of FIGS. 1 and 1A.
Figure 4:
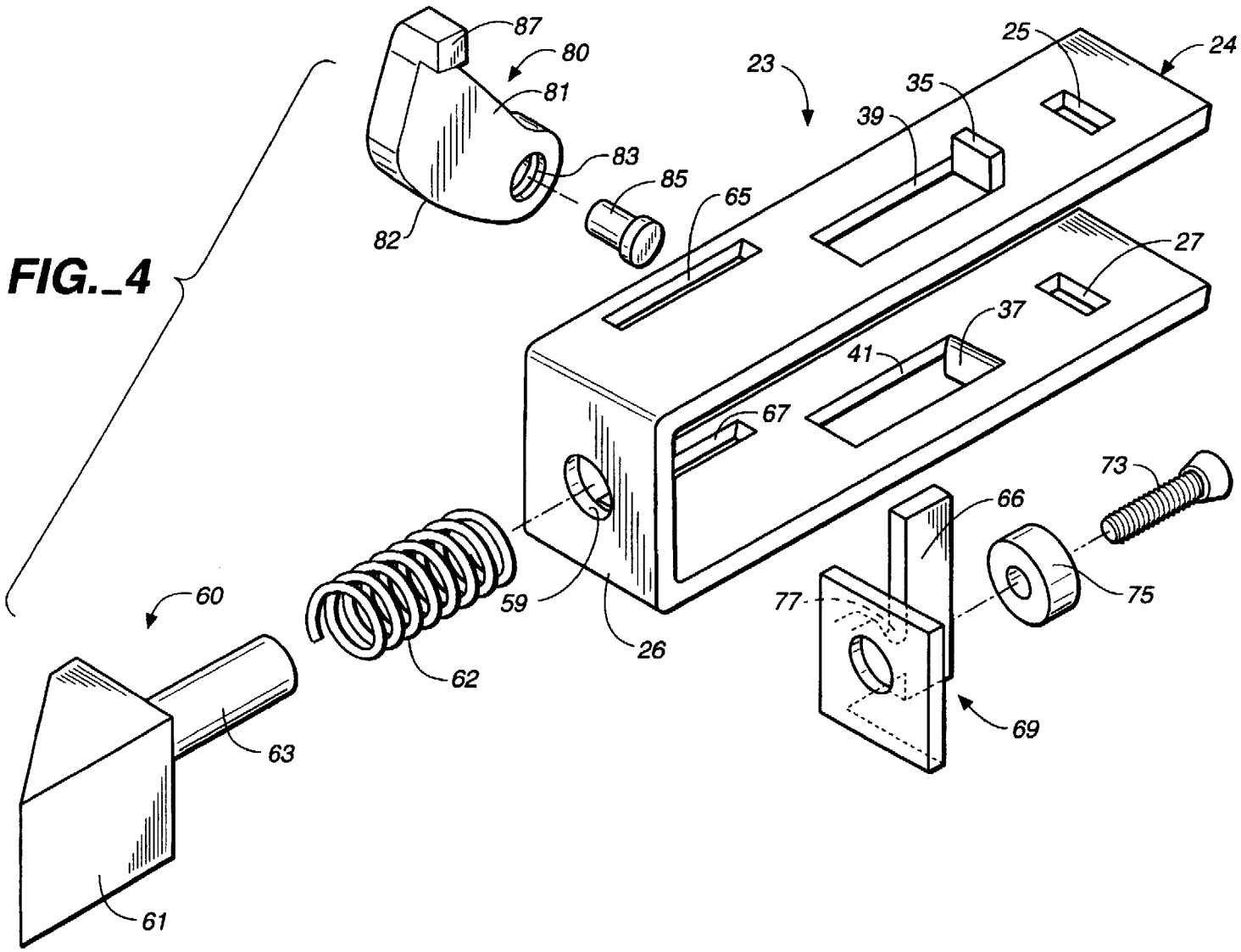
FIG. 4 shows an exploded perspective view of the various component parts of the present invention which are installed within the housing thereof.

As particularly seen in FIGS. 1, 1A and 4, the force transfer mechanism includes opposed slots 39 and 41 having their respective rearward extents defined by the respective tabs 35 and 37. As seen in FIGS. 1, 1A and 2, a first cam mechanism 43 includes a generally cylindrical body 45 rotatably mounted within opposed openings 42 and 44 within the housing 11. The body 45 includes a generally rectangular recess 47 sized to receive a protrusion (not shown) of the lever actuator 4 shown in FIG. 2.

Attached to the body 45 is a cam member 49 including protrusions 51 and 53 as well as cam surfaces 55 and 57. With particular reference to FIGS. 1 and 1A, the cam surface 55 is intended to bear against the tab 35 when the first cam mechanism is rotated in the clockwise direction in the view of FIG. 1, whereas the cam surface 57 is intended to bear against the tab 37 when the first cam mechanism 43 is rotated in the counterclockwise direction in the view of FIG. 1. As should be understood from comparison of FIGS. 1 and 1A, rotation of the first cam mechanism 43 in the clockwise direction results in reciprocation of the force transfer mechanism 23 in the right-hand direction in the view of FIGS. 1 and 1A. In similar fashion, rotation of the first cam mechanism 43 in the counterclockwise direction in the view of FIGS. 1 and 1A also results in right-hand movement of the force transfer mechanism 23 in the view of FIGS. 1 and 1A.

As shown in the figures, the force transfer mechanism 23 is open at its first end 24 and has a wall 26 defining its second closed end. The wall 26 has a circular opening 59 therethrough sized to slidably receive therethrough the cylindrical stem 63 of the latch bolt 60. The latch bolt 60 also includes the bolt 61 which, as seen in FIG. 1, is sized to be received within the recess 3 in the wall 2, and further includes further biasing means comprising a compression spring 62 interposed between the wall 26 of the force transfer mechanism 23 and a rear wall of the bolt 61 to bias the latch bolt 60 in the direction of receipt within the recess 3 of the wall 2.

As best seen in FIGS. 1, 1A and 4, the force transfer mechanism 23 includes further opposed guide slots 65 and 67 which guidingly receive the ends of a portion 66 of a fitting 69 slidably disposed within the force transfer mechanism 23. As best seen in FIG. 2, the portion 63 of the latch bolt 60 has a threaded recess 71 therein which threadably receives the screw 73 (FIG. 4) to fasten the fitting 69 to the rear face of the portion 63 of the latch bolt 60 within the force transfer mechanism 23. A washer 75 is interposed between the screw 73 and the fitting 69.

As seen in FIG. 4, in particular, the portion of the fitting 69 that is fastened to the rear face of the portion 63 of the latch bolt 60 comprises a generally flat plate, and between this flat plate and the portion 66 of the fitting 69, a recess 77 is defined.

With particular reference to FIGS. 2 and 4, a second cam mechanism is generally designated by the reference numeral 80 and is seen to include a cam member 81 having an opening 83 therethrough through which a fastener 85 extends to pivotably fasten the cam member 81 to the housing 11 (FIG. 2). The cam member 81 has an inwardly extending finger 87 and, with reference to FIG. 2, the cam member 81 extends within the force transfer mechanism 23 and a rear face of the plate 26 thereof engages the forward surface 82 (FIG. 4) of the cam member 81. The finger 87 of the cam member 81 extends into the recess 77 of the fitting 69.

With the present invention having been described in detail, the operation thereof will now be explained in detail.

With the various parts and components of the present invention in the position shown in FIG. 1, rotation of the handle 4 in the clockwise direction of FIG. 1 will cause rotation of the first cam mechanism 43 in the clockwise direction to thereby cause the surface 55 of the cam member 49 to engage the tab 35 thereby causing reciprocation of the force transfer mechanism 23 in the right-hand direction in the view of FIG. 1. When such movement takes place, the rear surface of the face 26 of the force transfer mechanism 23 engages the cam surface 82 of the second cam mechanism 80 thereby causing the finger 87 thereof within the recess 77 of the fitting 69 to also move in the right-hand direction of FIG. 1 to cause the fitting 69 as guided by the portion 66 received within the slots 65 and 67 of the force transfer mechanism 23 to move in the right-hand direction of FIG. 1 carrying, therewith, the latch bolt 60 to thereby cause the latch bolt 60 to retract within the housing 11 chamber 13 as seen in FIG. 1A. In such configuration, the associated door 1 may be opened with respect to the wall 2. As should be understood from comparison of FIGS. 1 and 1A, the finger 87 of the second cam member 81 moves several times the distance of movement of the force transfer mechanism 23, thus permitting slight movements of the lever 4 to translate to large movement of the latch bolt 61. As seen in FIG. 1A, the angle $\alpha$ subtended by rotation of the first cam mechanism 43 to a position permitting complete retraction of the latch bolt 61 is approximately 28°. As should be understood from those skilled in the art viewing these figures, the same operation of the latch bolt mechanism 60 will occur should the first cam mechanism 43 be rotated in the counterclockwise direction in the view of FIGS. 1 and 1A by rotation of the lever 4 in the opposite direction to that which was above described. Under such circumstances, as should be self-evident, the cam surface 57 of the first cam member 49 engages the tab 37 to thereby cause movement of the force transfer mechanism 23, again, in the right-hand direction in the view of FIGS. 1 and 1A to thereby retract the latch bolt 61 in the manner shown in FIG. 1A.

In the preferred embodiment of the present invention, the housing 11, first cam mechanism 43 and latch bolt mechanism 60 are made of case hardened steel to deter tampering with the mechanism 10. All of the other components of the present invention may be suitably made of materials such as metal, hard plastic or any other materials suitable for use in a latch mechanism.

As such, an invention has been disclosed in terms of a preferred embodiment thereof which fulfills each and every one of the objects of the invention as set forth hereinabove and provides a new and useful improved latch mechanism of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved latch mechanism, comprising:

a) a housing containing a force transfer mechanism biased by biasing means and said force transfer mechanism being constrained to linearly reciprocate within said housing;

b) a first cam mechanism coupled to said force transfer mechanism whereby rotation of said first cam mechanism about a first axis of rotation causes reciprocation of said force transfer mechanism against force exerted by said biasing means;

c) a second cam mechanism coupled to said force transfer mechanism whereby reciprocation of said force transfer mechanism causes rotation of said second cam mechanism about a second axis of rotation spaced from said first axis of rotation;

d) said second cam mechanism being coupled to a latch bolt whereby rotation of said second cam mechanism causes reciprocation of said latch bolt;

e) whereby rotation of said first cam mechanism results in reciprocation of said force transfer mechanism, rotation of said second cam mechanism and reciprocation of said latch bolt.

2. The mechanism of claim 1, wherein said housing is generally rectangular cubic.

3. The mechanism of claim 1, wherein said force transfer mechanism is generally U-shaped having a first open end and a second end closed by a wall.

4. The mechanism of claim 3, wherein said biasing means comprises a compression spring interposed between said housing and a spring stop mounted on said first end of said force transfer mechanism.

5. The mechanism of claim 1, wherein said first cam mechanism includes a generally cylindrical body rotatably disposed in said housing and a double cam member protruding through opposed slots in said force transfer mechanism.

6. The mechanism of claim 5, wherein said opposed slots terminate in respective rearward tabs engageable by said double cam member whereby rotation of said body in either direction causes reciprocation of said force transfer mechanism.

7. The mechanism of claim 3, wherein said wall has a rear surface engaging a cam surface of said second cam mechanism whereby rearward reciprocation of said force transfer mechanism causes rotation of said second cam mechanism.

8. The mechanism of claim 7, wherein said second cam mechanism is coupled to said latch bolt via a finger laterally protruding from said second cam mechanism and engaging a recess in a fitting mounted to said latch bolt.

9. The mechanism of claim 8, wherein said second cam mechanism is rotatably coupled to said housing.

10. The mechanism of claim 1, wherein said latch bolt is biased in a direction away from said force transfer mechanism by further biasing means.

11. The mechanism of claim 1, including a lever coupled to said first cam mechanism, rotation of said lever less than 30° resulting in complete retraction of said latch bolt within said housing.

12. The mechanism of claim 1, wherein when said first cam mechanism is rotated about said first axis, said latch bolt reciprocates a further distance than a distance of reciprocation of said force transfer mechanism.

* * * * *